US006049911A

United States Patent [19]

Bromberg

[11] Patent Number: 6,049,911

[45] Date of Patent: Apr. 18, 2000

[54] SIZED HEAD GEAR

[76] Inventor: Craig Bromberg, 2632 Chamonix, St. Laurent, Quebec, Canada, H4R 2X1

[21] Appl. No.: 09/241,229

[22] Filed: Feb. 1, 1999

[51] Int. Cl.[7] ..... A42B 1/00

[52] U.S. Cl. ..... 2/195.3; 2/12; 2/183

[58] Field of Search ..... 2/12, 171, 183, 2/195.2, 195.3, 195.4, 418, 420, DIG. 11

[56] References Cited

U.S. PATENT DOCUMENTS 5,428,843 7/1995 Clowers et al. ..... 2/195.3

*Primary Examiner*—Diana Oleksa

*Attorney, Agent, or Firm*—Wolf,Greenfield & Sacks; Ronald J. Kransdorf

[57] ABSTRACT

A baseball cap which is both functional and aesthetically pleasing with a crown portion and self-adjustable means made of fabric. Said self-adjustable means are made in part of extensible materials that are not exposed to engage the hair of the wearer. The baseball cap design is such that the cap does not bunch up. Such a baseball cap design provides a self-adjustable baseball cap, which provides a comfortable fit covering a range of head sizes in an aesthetically pleasing fashion.

26 Claims, 3 Drawing Sheets

SIZED HEAD GEAR

BACKGROUND OF THE INVENTION

1. Field of the Invention

The present invention relates to an improved design of a head gear, in particular to an improved construction of a self-adjustable rim of said head gear. This new design provides a sun shading style cap or shield of an adjustable size accommodating a variety of head sizes that is comfortable to wear and is aesthetically pleasing.

2. Description of the Prior Art

The primary functional quality of a baseball style cap is to provide sun shield for the protection of the wearer's head and eyes.

The goal sought is to provide a customer with an aesthetically pleasing product of high quality produced with minimum manufacturing, shipping and stocking costs. Increased costs come about from the necessity of providing a cap in many sizes according to the variation of head sizes of wearers. A general way to minimize costs is to manufacture a baseball cap which accommodates a range of head sizes. Baseball caps which accommodate a range of head sizes are provided with adjustable features.

The ultimate baseball cap as far as comfort is concerned is one that is tailored to fit the head size of the wearer. Given a large variation in wearers' head sizes, mass production, distribution and stocking of such caps would be costly.

Attempts have been made at manufacturing and distributing a one-size-fits-all baseball cap. One such cap is the ubiquitous adjustable baseball cap with a plastic snap tab assembly. Such a baseball cap has an open back; that is, the crown portion of the cap has a cutout at the back and plastic tabs attached to the ends of the rim. Size adjustment is attained by overlapping the plastic tabs, which snap together with different discrete degrees of overlap.

Another design includes a continuously adjustable belt with a buckle assembly.

Yet another development was the use of a Velcro™ strap. This design is described by Satterfield in U.S. Pat. No. 4,815,148, issued Mar. 28, 1989.

Some producers have opted for a compromise by providing a set of adjustable baseball caps which cover a limited range of head sizes. Such designs employ stretchable materials in their construction without the open back. One such design of a free-size cap is described by Cho in U.S. Pat. No. 5,715,540, issued Feb. 10, 1998, which makes use of stretchable materials for the crown portion and a stretchable sweatband around the perimeter of the cap.

Another design of a custom fit cap is described by Beckerman in U.S. Pat. No. 5,615,415, issued Apr. 1, 1997, in which the cap is described as having at least the back portion of the cap stretchable and a stretchable sweatband.

Yet another design of an adjustable cap is described by Clowers et al in U.S. Pat. No. 5,428,843, issued Jul. 4, 1995, in which a baseball cap of a maximum size within a range has a stretched elastic member stitched along its inferior border at regular intervals.

Although all these designs have some merit, they leave room for improvement. The plastic tab assembly provides only a discrete size adjustment method which often provides too large or too small a fit. Also, the plastic tabs are not very comfortable when the wearer is reclining backwards against a head rest. The belt assembly, while providing for a continuously adjustable fit as well as a softer adjustment assembly compared to the plastic tabs, still has an uncomfortable buckle. The use of Velcro™ straps provided a continuous adjustment and comfort. All three size adjustment methods for a baseball style cap just described require manual adjustment or readjustment.

The other designs described above are self-adjusting designs. However, the lack of the open back feature does not allow women wearers to pull a hair tail through the back, thus reducing comfort and convenience common to the previous open back designs. Also, the use of exposed stretchable materials tends to engage the hair of the wearer creating discomfort. The Clowers et al design presents a displeasing appearance for male wearers. Male wearers, of that baseball cap design, find that the cap gathers up along the rim and creates ruffles.

Given that the primary function of a baseball style cap is to provide a sun shield for a wearer, no baseball style cap can accommodate all hair styles.

SUMMARY OF THE INVENTION

An improved design of a baseball cap which is both functional and aesthetically pleasing is one whose crown portion and self-adjustable means are made from cloth material, whose self-adjustable means is made in part of extensible materials that are not exposed to engage the hair of the wearer, and whose design is such that the cap does not bunch up. Such a design provides a self-adjustable baseball cap, which provides a comfortable fit covering a range of head sizes in an aesthetically pleasing fashion.

It is the aim of the present invention to provide a self-adjustable cap or sun shield made largely of cloth material to comfortably fit a range of head sizes.

It is the aim of the present invention to provide a cap or sun shield with extensible self-adjustable means such that said extensible self-adjustable means are not exposed.

It is the aim of the present invention to provide a cap or sun shading shield whose self-adjustable means remains aesthetically pleasing.

An improved construction of a self-adjustable rim for head gear comprises a self-adjusting headband including: an elongated panel defining a rim interrupted by an opening, a sweatband attached to the panel and a self-adjusting band having a pair of ends extending across the opening. The sweatband extends around at least a portion of the rim of the headband and terminates at the opening forming headband ends. The sweatband also defines a channel with the panel. The self-adjusting band anchored within respective portions of the channel includes at least one portion made of extensible material and another portion made of inextensible material. The self-adjustable band is mounted such that the extensible portion is within the channel and only the inextensible portion is exposed at the opening. The inextensible portion moves telescopically in and out of the channel without exposing the extensible portion in the opening to provide a continuous size adjustment within a range.

An improved cap according to the present invention comprises a crown portion and a bill portion. The crown portion further comprises an open portion opposite to the bill portion having a pair of ends. A sweatband is attached to the rim of said crown portion between the ends of the opening and around at least a portion of the rim creating a channel. A self-adjusting band having a pair of ends is provided across the opening and anchored within respective portions of the channel. The self-adjustable band comprises at least one portion made of extensible material and another portion made of inextensible material. The self-adjustable band is mounted such that the extensible portion is within the channel allowing the inextensible portion thereof to move telescopically in and out of the channel without exposing the extensible portion in the opening.

The cap comprises a plurality of gores.

An improved sun shield, according to the present invention, comprises a headband portion and a bill portion. The headband portion comprises a rectangular panel. The headband portion having a pair of ends, does not form a complete circular shape, leaving an opening opposite to the bill portion. A sweatband is attached at least to the lower edge of said rectangular portion between the ends of the opening and around at least a portion of the lower edge creating a channel. A self-adjusting band having a pair of ends is provided across the opening with each end anchored within respective portions of the channel. The self-adjustable band comprises at least one portion made of extensible material and another portion made of inextensible cloth material. The self-adjustable band is mounted such that the extensible portion is within the channel allowing the inextensible portion thereof to move telescopically in and out of the channel without exposing the extensible portion in the opening.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
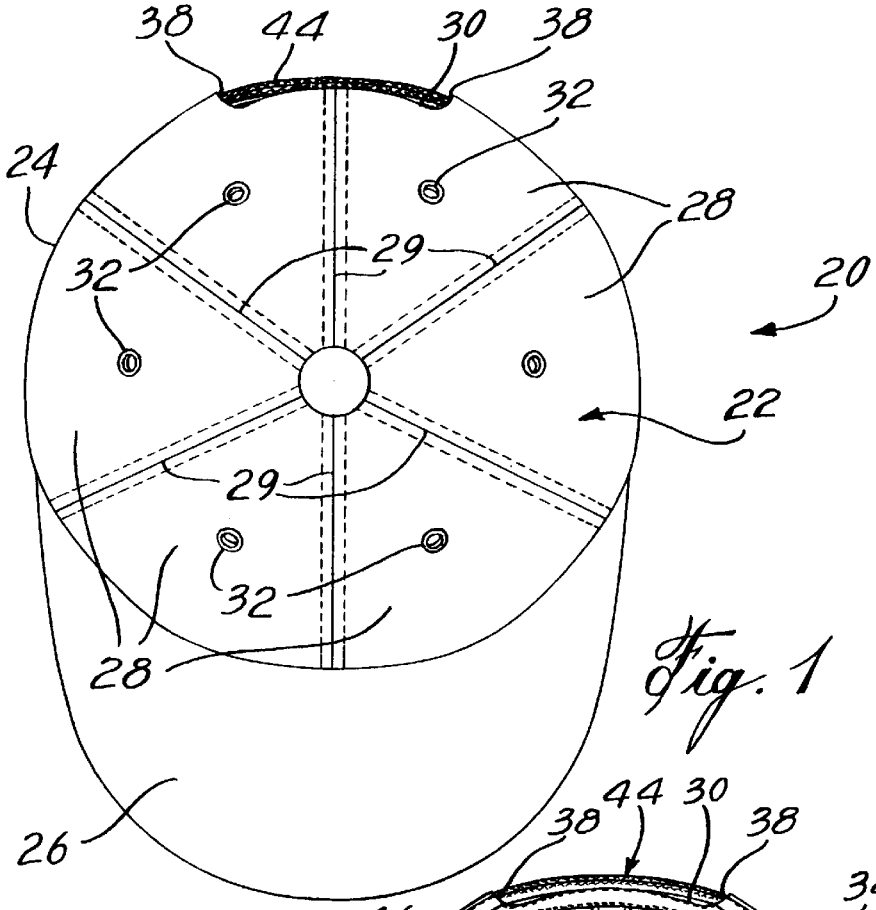
FIG. 1 illustrates a top plan view of a self-adjustable baseball style cap.

According to an embodiment of the present invention, a baseball style cap 20 presented in FIG. 1 comprises a substantially hemispherical crown portion 22. The crown portion 22 has a rim 24 to which a bill portion 26 is connected. The bill portion 26 is substantially stiffened and is mounted at an angle with respect to the crown portion 22.

The crown portion 22 is made up of gores 28. Gores 28 are made from cloth material and of particular individual shapes so that when stitched together at 29 form the hemispherical/dome shape of crown portion 22. Generally, gores 28 are made of durable fabric with some of the gores 28 at the front of the crown portion being 22 stiffened using materials known in the art to enhance the appearance of the cap 20. Some of the gores 28, generally located at the back of the cap 20, are shaped such that the cap 20 has an arched opening 30 having a pair of ends 38. Another feature of the crown portion 22 is a set of ventilation openings 32.

Figure 2:
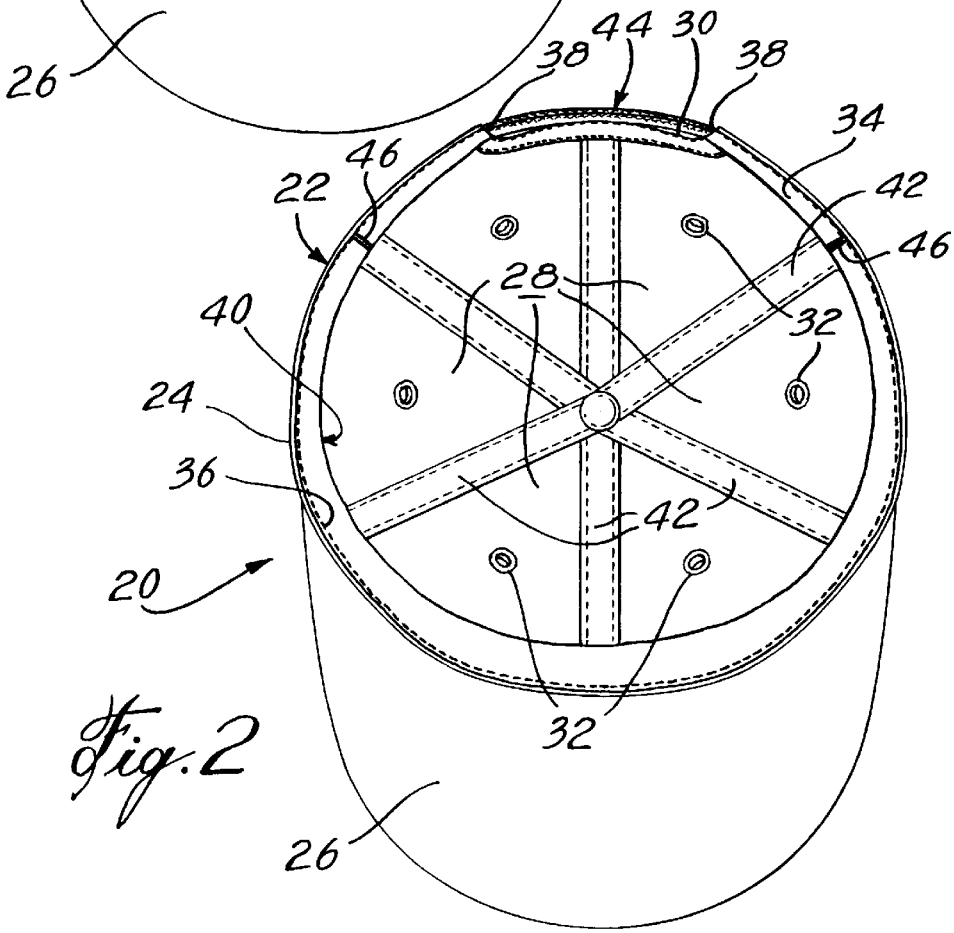
FIG. 2 illustrates a bottom plan view of a self-adjustable baseball style cap.

A sweatband 34 is stitched at 36 around the rim 24 and on the interior of the crown portion 22 as seen in FIG. 2. The sweatband 34 extends between the ends 38 of the back opening 30 thereby forming a channel 40 with the crown portion 22. The sweatband 34 is generally made of absorbent materials to absorb sweat.

Other features seen in FIG. 2 are seam covers 42 and self-adjusting band 44 which spans between the ends 38 of back opening 30 and is anchored with stitches 46 to the sweatband 34 at locations spaced away from the ends 38 of the opening 30.

Figure 3:
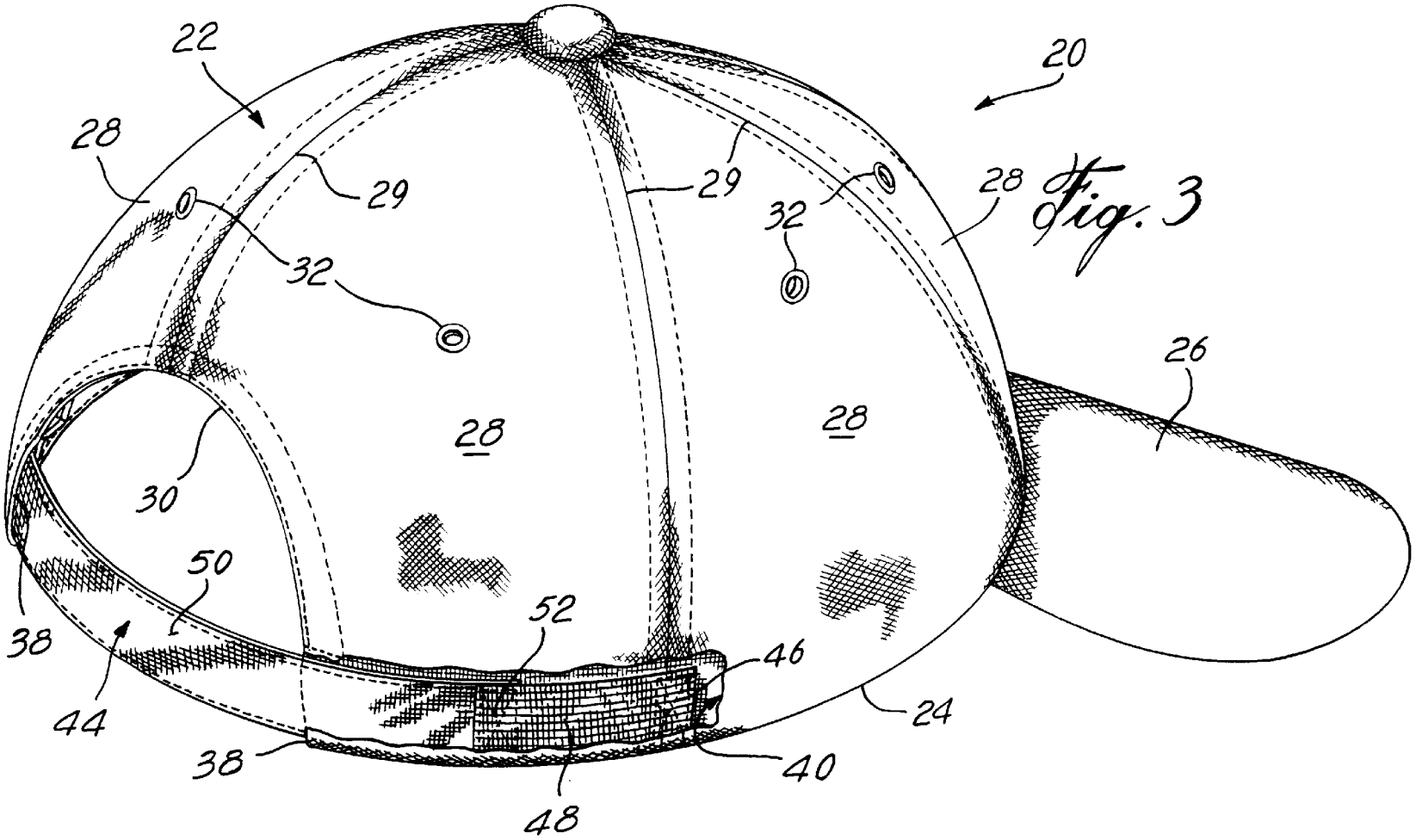
FIG. 3 illustrates a perspective view of a self-adjustable baseball style cap with a detail showing the adjustable means of the self-adjustable baseball style cap as it is adjusted for the smallest diameter in the range of sizes it covers.

The self-adjusting band 44, as shown in FIG. 3, comprises two substantially extensible portions 48 (one shown) and a substantially inextensible portion 50. The extensible portions 48 and the inextensible portion 50 are stitched at 52 to form the substantially elongated rectangular self-adjusting band 44.

Figure 4:
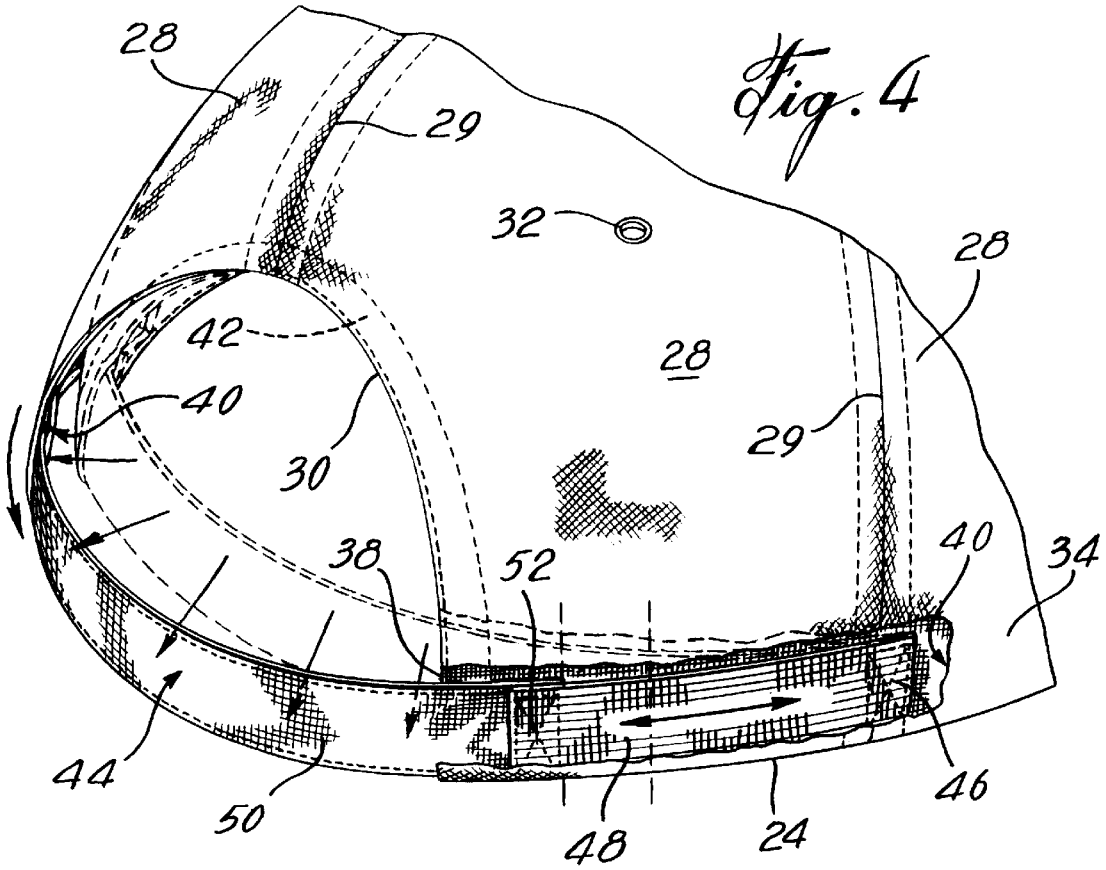
FIG. 4 illustrates a detail which shows a self-adjustable baseball style cap as it is adjusted for the largest diameter in the range of sizes it covers.

FIGS. 3 and 4 show how the self-adjusting action is accomplished. FIG. 3 illustrates the self-adjustable baseball style cap 20 as it is adjusted for the smallest diameter in the range of sizes it covers. The inextensible portion 50 of self-adjusting band 44 passing through ends 38 of channel 40 is retracted into the channel 40 as the extensible portions 48 are relaxed. FIG. 4 illustrates the self-adjustable baseball style cap 20 as it is adjusted for the largest diameter in the range of sizes it covers. The inextensible portion 50 of self-adjusting band 44 passing through ends 38 of channel 40 is substantially out of the channel 40 as the extensible portions 48 are stretched to their maximum extent without being exposed.

A cap in accordance with an embodiment of the present invention would be made in different categories of sizes starting at infants of 0 to 24 months old; 2 to 3 years old; 4 to 6; 7 to 14; 15 to 18 and adult.

Figure 5:
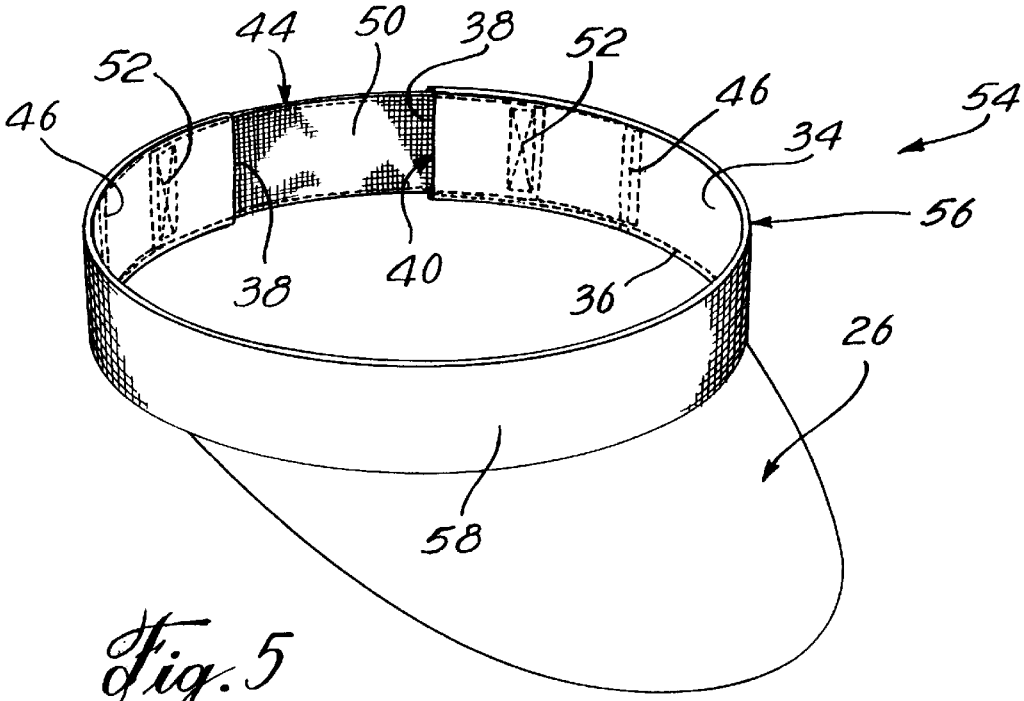
FIG. 5 illustrates a perspective view of a self-adjustable sun shield.

According to another embodiment of the present invention, FIG. 5 shows a sun shield 54 comprising a headband portion 56 and a bill portion 26. The bill portion 26 is substantially stiffened and is mounted at an angle with respect to the headband portion 56.

The headband portion 56 comprises a rectangular panel 58 having a pair of ends 38 forms an open circular shape, a sweatband 34 stitched at 36 to the rectangular panel 58 forming a channel 40, and a self-adjustable band 44 with inextensible portion 50 entering channel 40 through ends 38. The self-adjustable band 44 is stitched at 46 to the sweatband 34 spaced away from the ends 38. Two extensible portions 48 (not shown) stitched to inextensible portion 50 at 52 allow the inextensible portion 50 to move in and out of channel 40 in a telescopic fashion without exposing the extensible portions.

According to other embodiments of the present invention, the self-adjusting band comprises only one substantially extensible portion 48 and a substantially inextensible portion 50. The extensible portion 48 and the inextensible portion 50 are stitched at 52 to form the substantially elongated rectangular self-adjusting band 44.

I claim:

1. A self-adjusting headband for head gear comprising:

an elongated panel defining a rim interrupted by an opening;

a sweatband attached to said panel and extending around at least a portion of the rim of said headband and terminating at the opening forming headband ends, said sweatband defining a channel with said panel;

self-adjusting means having a pair of ends extending across the opening and anchored within respective portions of the channel including;

at least one portion made of extensible material and another portion made of inextensible material;

said self-adjustable means mounted such that the extensible portion is within the channel and the inextensible portion is exposed at the opening and moves telescopically in and out of the channel.

2. The headband as defined in claim 1, wherein said sweatband is connected at least to the lower edge of and at least to a portion of said elongated panel to form said channel between said sweatband and said elongated panel.

3. The headband as defined in claim 2, whereby said self-adjustable means is anchored within the channel at locations spaced from the headband ends.

4. The headband as defined in claim 1, whereby the self-adjustment means includes one extensible portion connected to an end of said inextensible portion.

5. The headband as defined in claim 4, whereby an end of said extensible portion of said self-adjusting means is anchored within said channel, spaced apart from said ends of said headband such that said extensible portion remains entirely in said channel even if it is extended to its maximum extension; and the other end of said self-adjustment means is anchored within said channel, spaced apart from the other end of said headband, such that only said inextensible portion is exposed at any particular size adjustment and said inextensible portion moves with a telescopic action in and out of said channel.

6. The headband as defined in claim 1, whereby the self-adjustment means includes two extensible portions connected to respective ends of said inextensible portion.

7. The headband as defined in claim 6, whereby the ends of said extensible portions are anchored within said channel, spaced apart from respective said ends of said headband, such that said extensible portions remain entirely in said channel even if they are extended to their maximum extension, such that only said inextensible portion is exposed at any particular size adjustment and said inextensible portion moves with a telescopic action in and out of said channel.

8. A cap comprising:

a crown portion defining a rim interrupted by an opening;

a sweatband attached to said crown portion at the rim and extending around at least a portion of the rim of said crown portion, the sweatband defining a channel with the crown portion at the rim terminating at the opening and forming channel ends;

self-adjusting means having a pair of ends extending across said opening and anchored within respective portions of the channel including:

at least one portion made of extensible material and another portion made of inextensible material;

said self-adjustable means mounted such that the extensible portion is within the channel and the inextensible portion is exposed at the opening and moves telescopically in and out of the channel.

9. The cap as defined in claim 8, wherein said cap includes a bill portion attached to the rim of the crown opposite the opening and the crown includes a plurality of gores generally forming a hemispherical shape.

10. The cap as defined in claim 9, whereby said bill portion is substantially stiffened.

11. The cap as defined in claim 9, whereby said self-adjustable means is substantially rectangular and elongated.

12. The cap as defined in claim 11, whereby an end of said extensible portion is anchored within said channel spaced apart from said end of said channel, such that said extensible portion remains entirely in said channel even when extended to its maximum extension; and the other end of said self-adjusting means is anchored within said channel spaced apart from the other end of said channel, such that only said inextensible portion is exposed at any particular size adjustment and moves, with a telescopic action, in and out of the said end of said channel.

13. The cap as defined in claim 8, whereby the self-adjustment means includes one extensible portion connected to an end of said inextensible portion and forms an end of the self-adjustment means whereby the other end of the self-adjustment means is that of the inextensible portion, the ends of said self-adjustment means are anchored within the respective channel portions.

14. The cap as defined in claim 8, whereby two extensible portions are connected to respective ends of said inextensible portion forming the ends of the self-adjustment means and are anchored within the respective channel portions.

15. The cap as defined in claim 14, whereby said ends of said two extensible portions are anchored within said channel spaced apart from respective said ends of said channel, such that said two extensible portions remain entirely in said channel even when extended to their maximum extension, such that only said inextensible portion is exposed at any particular size adjustment and moves, with a telescopic action, in and out of the said ends of said channel.

16. The cap as defined in claim 15, wherein the cap is a sun shield.

17. A sun shield comprising:

a headband portion defining a rim interrupted by an opening including:

an elongated rectangular panel and a sweatband attached to said rectangular panel and extending around at least a portion of the rim of said headband portion, the sweatband defining a channel with the rectangular panel terminating at the opening and forming channel ends;

self-adjusting means having a pair of ends extending across the opening and anchored within respective portions of the channel including;

at least one portion made of extensible material and another portion made of inextensible material;

said self-adjustable means mounted such that the extensible portion is within the channel and the inextensible portion is exposed in the opening to move telescopically in and out of the channel.

18. The sun shield as defined in claim 17, wherein a substantially stiffened bill portion extends forward from the middle of said headband.

19. The sun shield as defined in claim 18, wherein said self-adjusting means is opposite to said bill portion.

20. The sun shield as defined in claim 17, wherein said sweatband is connected at least to the lower edge of and at least to a portion of said rectangular panel to form said channel between said sweatband and said rectangular panel.

21. The sun shield as defined in claim 20, whereby said self-adjustable means enters said channel through the ends of said channel and is anchored therewithin at locations spaced from said ends.

22. The sun shield as defined in claim 17, whereby said self-adjustable means is substantially rectangular and elongated.

23. The sun shield as defined in claim 17, whereby the self-adjustment means includes one extensible portion connected to an end of said inextensible portion.

24. The sun shield as defined in claim 23, whereby an end of said extensible portion of said self-adjustable means is anchored within said channel, spaced apart from said ends of said channel such that said extensible portion remains entirely in said channel even if it is extended to its maximum extension; and the other end of said self-adjustment means is anchored within said channel, spaced apart from the other end of said channel, such that only said inextensible portion is exposed at any particular size adjustment and moves with a telescopic action in and out of the said end of said channel.

25. The sun shield as defined in claim 17, whereby the self-adjustment means includes two extensible portions connected to respective ends of said inextensible portion.

26. The sun shield as defined in claim 25, whereby the ends of said extensible portions are anchored within said channel, spaced apart from respective said ends of said channel, such that said extensible portions remain entirely in said channel even if they are extended to their maximum extension, such that only said inextensible portion is exposed at any particular size adjustment and moves with a telescopic action in and out of the said ends of said channel.

* * * * *